US006931802B2

(12) United States Patent
Jones et al.

(10) Patent No.: US 6,931,802 B2
(45) Date of Patent: Aug. 23, 2005

(54) FLOOD PROTECTION BARRIER

(76) Inventors: Robert Alexander Jones, Dee View, Chester Road, Flint, North Wales (GB), CH6 5DT; Peter Anthony Jones, Sevenoaks, Coed Llys, Bryn-y-Garreg, Flint Mountain, North Wales (GB), CH7 6PG ( * ) Notice: Subject to any disclaimer, the term of this patent is extended or adjusted under 35 U.S.C. 154(b) by 37 days.

(21) Appl. No.: 10/439,683

(22) Filed: May 16, 2003

(65) Prior Publication Data

US 2004/0006937 A1 Jan. 15, 2004

Related U.S. Application Data

(63) Continuation-in-part of application No. PCT/GB01/04897, filed on Nov. 2, 2001.

(30) Foreign Application Priority Data

Nov. 16, 2000 (GB) ..... 0028066
Dec. 19, 2000 (GB) ..... 0031041
Jan. 29, 2001 (GB) ..... 0102215

(51) Int. Cl.[7] ..... E06B 7/00
(52) U.S. Cl. ..... 52/202; 52/656.7
(58) Field of Search ..... 52/202, 208, 645, 52/656.7; 49/55, 61, 62, 463, 465, 466, 57; 405/87, 107, 115, 52; 160/216, 374, 375

(56) References Cited

U.S. PATENT DOCUMENTS 2,316,688 A * 4/1943 Haase ..... 49/464
2,550,856 A * 5/1951 Ouellet et al. ..... 292/6
2,848,761 A * 8/1958 Hahn ..... 52/208
3,796,010 A * 3/1974 Carlson ..... 49/477.1
3,861,081 A * 1/1975 Maskell ..... 49/70
4,682,443 A * 7/1987 Demo ..... 49/466
4,837,974 A * 6/1989 Jokel ..... 49/55
5,077,945 A * 1/1992 Koeniger ..... 52/169.14
5,943,832 A * 8/1999 Russell ..... 52/202
6,334,282 B1 * 1/2002 Wood ..... 52/202
6,341,455 B1 * 1/2002 Gunn ..... 52/202
6,363,670 B1 * 4/2002 Dewitt ..... 52/202
6,425,707 B1 * 7/2002 Baxter ..... 405/87
6,427,396 B1 * 8/2002 Harrison ..... 52/202
6,591,553 B1 * 7/2003 Vaughn ..... 49/496
2004/0006937 A1 * 1/2004 Jones et al. ..... 52/202

FOREIGN PATENT DOCUMENTS

DE 29710143 U1 3/1998
DE 19937369 A1 6/2000
GB 2086456 A 5/1982
WO WO 99/22109 A1 5/1999

* cited by examiner

*Primary Examiner*—Brian E. Glessner
*Assistant Examiner*—Basil Katcheves
(74) *Attorney, Agent, or Firm*—Taylor Russell & Russell, P.C.

(57) ABSTRACT

A flood protection barrier is disclosed that can be deployed in the event of an immanent flood risk. The barrier comprises a shield having a sealing element and securing means for securing the shield in place to at least partially close an aperture in a wall of a building. The sealing element forms a fluid-resistant seal between barrier and the periphery of the aperture thereby resisting passage of water through the aperture. The barrier can be secured by securing means that require no modification to the building. The securing means may include clip assemblies or, in alternative embodiments, wedges or other suitable components.

20 Claims, 4 Drawing Sheets

FLOOD PROTECTION BARRIER

This is a continuation-in-part of International Application PCT/GB01/04897, with an international filing date of Nov. 2, 2001, published in English under PCT Article 21(2) as International Publication Number WO 02/40818 A1.

BACKGROUND TO THE INVENTION

1. Field of the Invention

This invention relates to a flood protection barrier. In particular, it relates to a flood protection barrier that can be installed to protect premises from an imminent flood risk.

As is well known, rising floodwater can cause extensive damage to the fabric and content of a building with alarming rapidity. Heavy rain and/or high tides can cause rivers to burst their banks and inundate a large area.

Traditionally, there has been little contingency action available to premises owners other than building a defensive barrier of sand bags. Sand bags can act as a reasonably effective filter to remove mud from floodwater. However, these are inconvenient, require a large amount of time and labour to install, can be used only once and, most particularly, they do not act as a good barrier to water entering premises.

2. Summary of the Prior Art

There have been various proposals for barriers to prevent floodwater from entering premises through a door or window opening. However, these typically require permanent installation of fittings (such as mounting channels) to the building in the region of the doorway to which a removable barrier can be connected in use. While such barriers can provide an effective flood defence, many occupiers do not wish to have permanent fixtures mounted on their premises. These fixtures may detract from the appearance of their premises or be otherwise inconvenient on a permanent basis, while they are needed for use only in the event of a flood; an event that may happen only once in many years. It is also apparent that many of these known devices might be subject to theft or tampering whilst in use.

An aim of this invention is to provide a flood protection barrier for a door or other aperture in a building that can be deployed rapidly as and when required, yet leave no (or minimal) fixtures in place while the barrier is not required for use in times of normal weather.

Accordingly, from a first aspect, the invention provides a flood protection barrier that comprises a shield having a sealing element and securing means for securing the shield in place to at least partially close a door or window aperture in a wall of a building, the aperture having a door or window frame; in which: the securing means cooperates with a surface of the building at the periphery of the aperture or the frame, and the sealing element forms a fluid-resistant seal between the barrier the frame at the periphery of the aperture.

Such a barrier can be deployed as and when required to protect against an imminent flood risk.

Advantageously the securing means is carried on the shield. More specifically, the securing means may be entirely carried on the shield. This has a twofold advantage, in that no part of the securing means is left in position on a building when the barrier is not in use, and in that the securing means are unlikely to be misplaced; this being especially important because they may be required for use as a matter of urgency.

For example, it may be adapted to cooperate with the frame. Advantageously, the securing means may be configured to be accessible only from within a building that the barrier is deployed to protect.

This reduces the likelihood that the securing means will be subject to unauthorised tampering. It is advantageous that the barrier, when deployed, does not prevent closure of the door or window. This may be achieved by providing securing means that cooperate with an outer part of the frame or the reveal adjacent to the frame. Alternatively, in the case of embodiments according to the last-preceding paragraph, the securing means may cooperate with an inwardly directed surface in the region of a recess into which the door or window (as the case may be) is received when closed. Provided that the securing means is suitably dimensioned (i.e. thin enough) it will not prevent closure of the door or window, thereby ensuring that the building upon which the barrier is deployed can be secured.

Typically, the securing means includes a plurality of clip means. Each clip means can be deployed to secure the shield to a formation of the frame. Each clip means may be adjustable to enable it to be secured to a range of different frames. For example, it may include two mutually adjustable components, one of which is fixed in relation to the shield.

Most typically, the shield is made of a rigid material, such as suitable plastic, wood or composite material. The shield must have sufficient rigidity to resist pressure of water that it is likely to encounter while distorting by no more than an acceptable amount. The shield may have a generally flat face (or a flat peripheral region of a face) that engages with the periphery of the aperture. An opposite face of the shield may be provided with strengthening formations.

Each shield is advantageously formed with a dimension that is greater than a corresponding dimension of the aperture. Such a shield may be placed against an external surface of the aperture, such that water in contact with the shield acts to push the shield into engagement with the external surface, and thereby assist in locating it in place.

The sealing element may include an elongate flexible plastic material element. A portion of sealing element may extend along part of a flat surface of the shield. Such a portion of the sealing element may engage, in use, with a face portion of a frame (such as a door or window frame) of the aperture. A further portion of the sealing element may extend along part of a peripheral surface of the shield. Such a further portion may engage with a sill or step portion of a frame of the aperture. In addition, such a further portion may engage with a portion of another barrier, for example, such that a plurality of such barriers can be stacked one upon the other in order that a user can select the height of a barrier to be deployed. (That is to say, several such barriers may be placed one on top of another to form a barrier of greater total height.)

From a second aspect, the invention provides a flood barrier assembly comprising a plurality of flood barriers, each according to any preceding claim, disposed adjacent to one another to form a water resistant barrier assembly for an aperture in a wall.

DETAILED DESCRIPTION OF THE PREFERRED EMBODIMENTS

Figure 1:
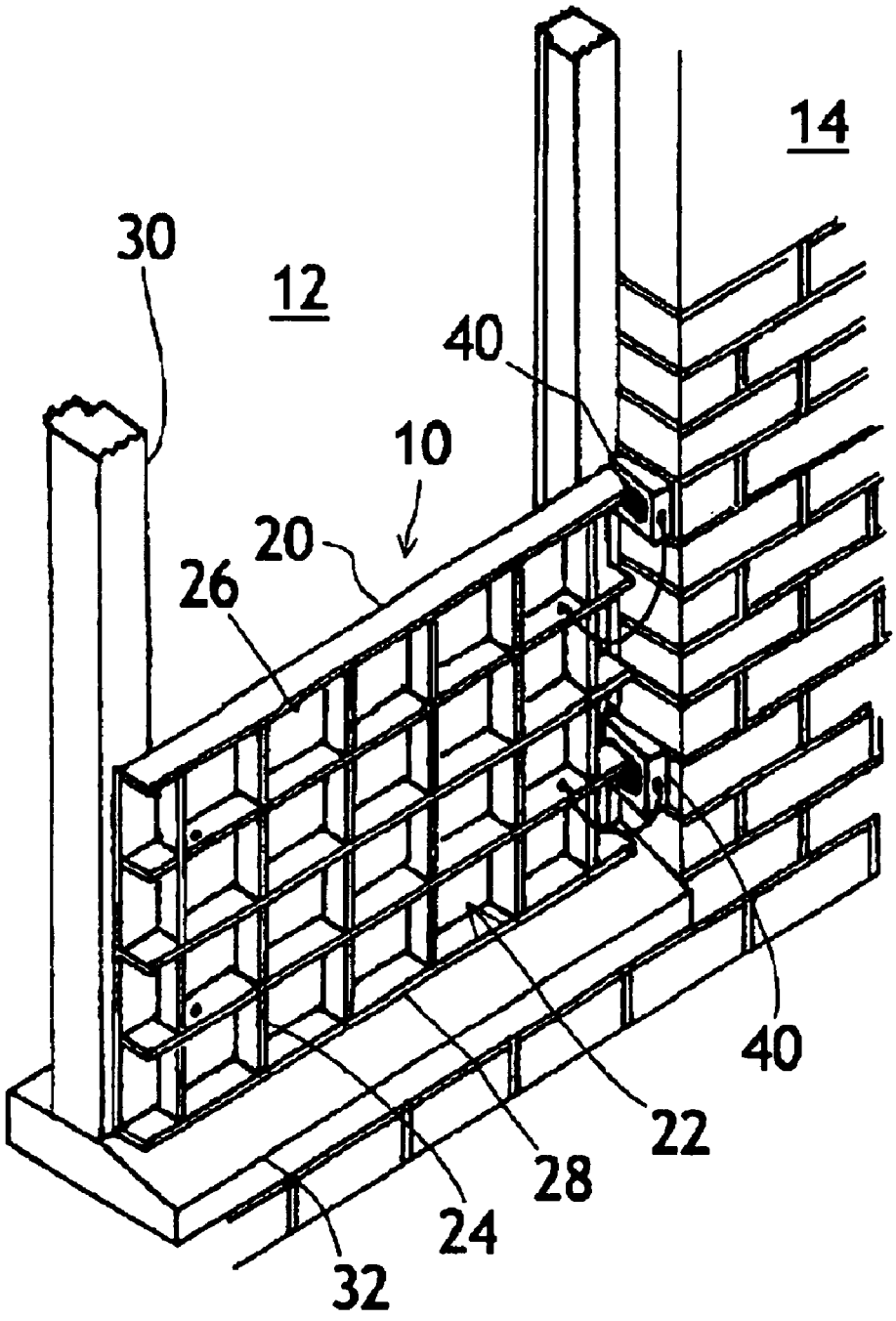
FIG. 1 is a perspective view of a flood barrier being a first embodiment of the invention, in position within a door recess, viewed from outside of a building.

With reference first to FIG. 1, there is shown a flood protection barrier 10 being a first embodiment of the invention. This embodiment is intended to resist floodwater entering a building through a door aperture 12 formed in a wall 14 of the building.

The barrier 10 includes a shield 20. The shield 20 includes a generally rectangular plate member 22 formed of a stiff, water-resistant material such as a tough polymer, a composite (e.g. glass-reinforced plastic) or suitably treated timber sheet.

One side of the plate member 22 (disposed to face into the door aperture, as shown in FIG. 1) is generally flat, and carries sealing elements, to be described below. The opposite side of the plate member (disposed to face out from the door aperture, as shown in FIG. 1) is formed with a plurality of strengthening ribs 24, arranged, in this embodiment, in a grid disposition. As will be understood, strengthening may be included on the plate member 22 as required to impart the shield 20 with sufficient stiffness. This will differ from one embodiment to another. The strengthening ribs (or other elements) may be formed integrally with the plate member or may be separate components applied to it. Upper and lower flanges 26, 28 project from upper and lower edge regions of the plate member 22.

The shield 20 is installed with the plate member 22 against upright members 30 of a frame of the door aperture 12. The lower flange 28 is supported upon a sill member 32 of the frame 30.

Elongate sealing elements (not shown) are applied to the shield 20 that form a water-resistant seal between the shield 20 and members 30 of the frame. Typically, the sealing elements are carried on the plate member to seal against upright members 30 of the frame and on the lower flange 28 to seal against the sill member 32. In alternative frame structures (typically used in aluminium or uPVC doors) there is an upright member extending up the sill 32 against which sealing elements may seal.

The sealing elements can be formed as elongate extrusions of flexible plastic material, such as foam plastic or natural or synthetic rubber. These extrusions are secured to the shield 20 by adhesive. The sealing elements may be applied to the shield 20 during its manufacture, or they may be supplied separately for application upon deployment of the barrier.

Figure 2:
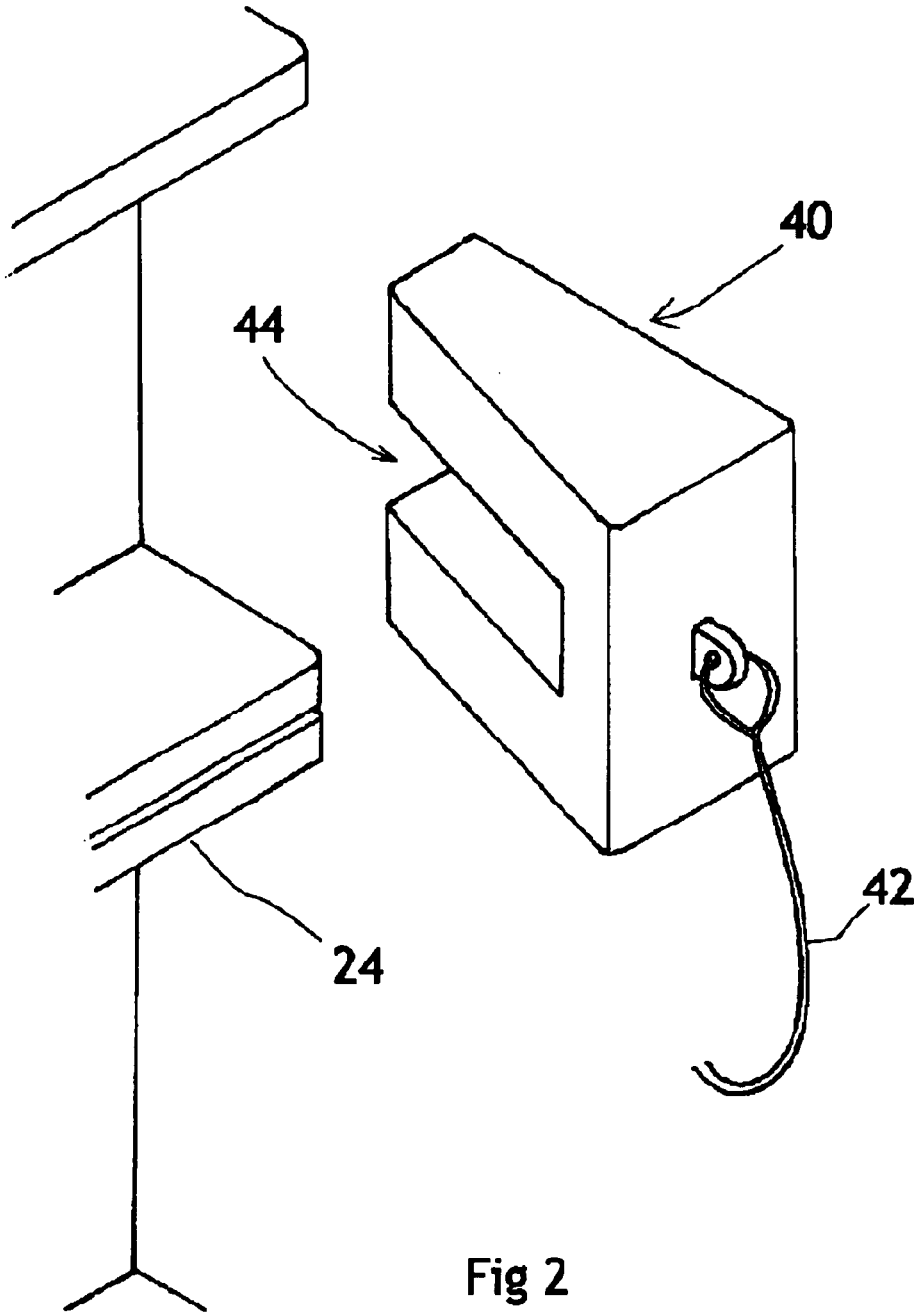
FIG. 2 illustrates a securing means being a component of the flood barrier of FIG. 1.

With reference now to FIGS. 1 and 2, a system by means of which the barrier 10 is retained in place within a doorframe will now be described.

The barrier 10 is provided with a plurality (in this case, four) wedge elements 40. Each of these is tethered to the barrier 10 by a length of flexible rope or wire 42 in order that they will not become separated from the barrier 10.

Each wedge element 40 includes a wedge-shaped body within a sloping surface of which is formed a groove 44. In order to secure the barrier 10 in place, the wedges are driven between the barrier 10 and the periphery of the aperture into which the barrier is to be located.

In order to deploy the barrier 10, the shield 20 is placed against the outside of the frame with its sealing elements in contact with members of the frame. The sealing elements therefore form a seal with outwardly-directed elements of the frame. The wedge elements 40 are then driven between the shield and the reveal surrounding the frame to retain the barrier in position against the frame. Each wedge element 40 is located such that an end portion of one of the ribs 24 is located within the groove 44. This assists in retaining the wedge elements 40 in place.

An alternative embodiment of the invention will now be described with reference to FIG. 3, FIG. 4A and FIG. 4B.

The barrier 50 of this embodiment of the invention includes a shield 52 that is of substantially the same construction as the shield 20 of the first embodiment. Likewise, the shield 52 carries sealing elements 70 that can form a seal between the shield 52 and a door or window frame member 65.

In this embodiment, the barrier is retained in position on the frame member 65 by a plurality of (in this case, four) clip assemblies 54. Within the scope of this invention, a large variety of clip assembly structures could be employed, and it should be understood that the clip assembly described is just one of many possibilities.

Each clip assembly 54 includes a first component 56 that is secured to the shield 52 or by a fastener such as a nut 58. A second component 60 is adjustably attached to the first component 56 by a fastener such as a nut 62. The second component 60 of the clip assembly 54 is shaped to engage with a recess formation 64 of the frame member 65. The recess formation 64 with which the clip assembly 54 cooperates is formed by the recess formation 64 into which the door or window (as the case may be) is received when closed.

In order to deploy the barrier 50, the shield 52 is placed against the outside surface 67 of the frame member 65 with its sealing elements 70 in contact with members of the frame 65. The second component 60 of the clip assembly 54 is then brought into engagement with the recess formation surface 64 of the frame member 65. The shield 52 is pushed into contact with the frame member 65, and the second component 60 is pushed against a recess formation surface 66 within the recess formation 64 that faces into the building 74, and the nut 62 is then tightened. This is then repeated for all four clip assemblies. The second component 60 is sufficiently thin that it can fit between the door or window 68 (shown in ghost lines at 68 in FIG. 3) and the frame member 65, thus allowing the door or window 68 to be closed while the barrier 50 is deployed.

Figure 3:
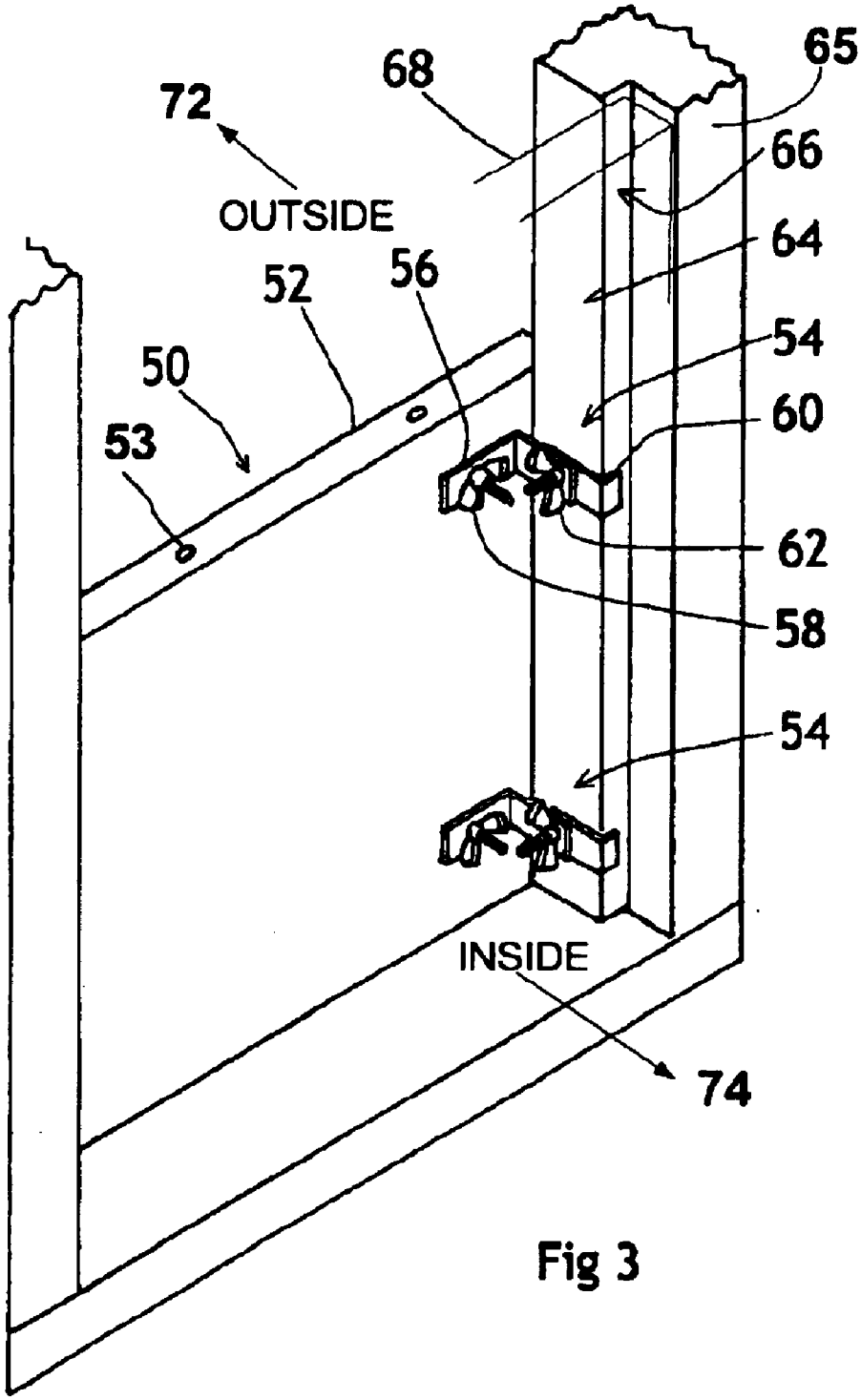
FIG. 3 is a perspective view of a flood barrier being a second embodiment of the invention, in position within a door recess, viewed from within a building.
Figure 4A:
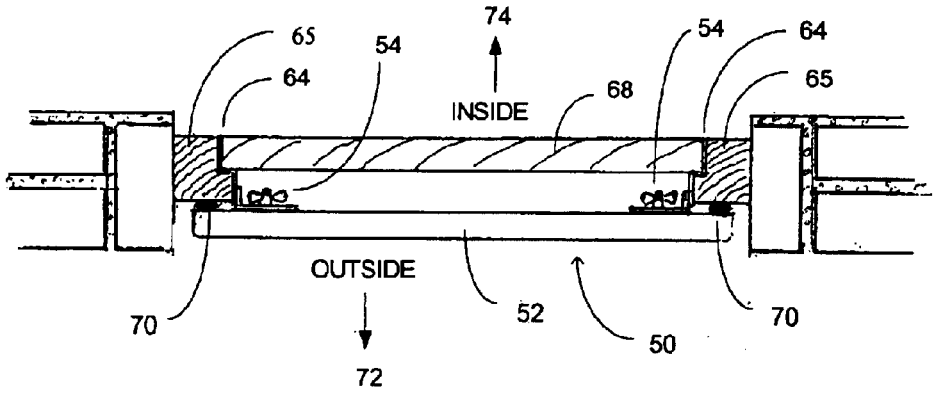
FIG. 4A is a cross-sectional view of the flood barrier shown in FIG. 3.
Figure 4B:
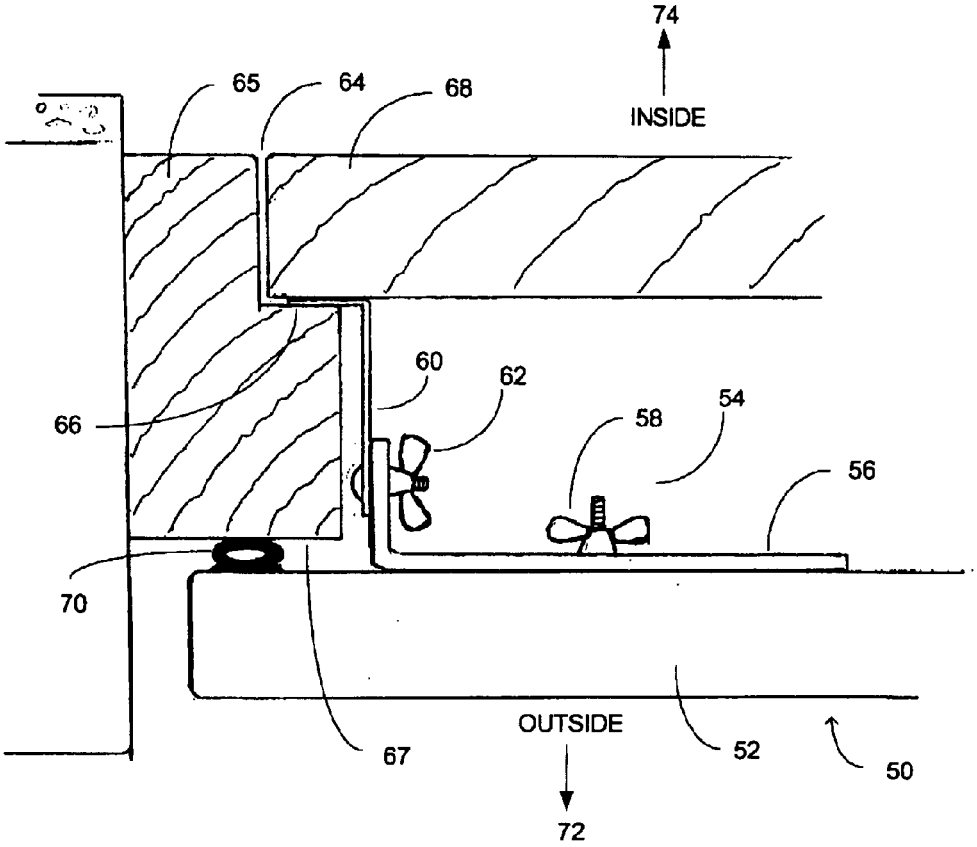
FIG. 4B is an exploded cross-sectional view of an end of the flood protection barrier shown in FIG. 4A.

As can be seen in FIG. 3, FIG. 4A and FIG. 4B, access to the clip assemblies can be gained only from within the building 74, such that they cannot be dislodged by floating articles or deliberately tampered with from outside of the building 72. Moreover, the presence of the clip assemblies does not prevent the door or window 68 being closed while the barrier 50 is deployed.

As will be understood, the barrier 50 is retained in place by the clip assemblies 54. The presence of the sealing elements 70 resists or prevents ingress of water through the door or window aperture. (This applies to both of the described embodiments.) In the event of water rising to the outside of the building, the water pushes against the shield and urges its sealing elements 70 into closer contact with the frame member 65, thereby enhancing their ability to provide a watertight seal.

In the event that there is a risk that floodwater will rise above the height of the shield 52, a further shield may be installed above a first shield 52 such that the shields are stacked one upon another within the door or window opening. To enhance the security of such a configuration, the shields 52 may be interconnected by fasteners (for example, nuts and bolts) inserted through suitably placed holes 53 in adjacent horizontally extending members of the shields.

What we claim is:

1. A flood protection barrier in combination with a door or window aperture in a wall of a building, the aperture having door or window frame members that include inwardly-facing recess formations for receiving a door or window and outwardly-facing surfaces, the flood protection barrier comprising:

a shield having a sealing element and securing means for securing the shield in place;

the securing means including a plurality of clip means, each clip means including at least two mutually adjustable coupled components, a first adjustable coupled component affixed to the shield and connecting to a second adjustable coupled component, the second adjustable coupled component connected to an inwardly-facing recess formation of a frame member; and the sealing element forming a fluid-resistant seal between the shield and an outwardly-facing surface of the frame member at the periphery of the aperture.

2. A flood barrier according to claim 1 in which the securing means is carried entirely on the shield.

3. A flood barrier according to claim 1 in which the securing means is adapted to engage with a periphery of the aperture that the barrier is deployed to protect.

4. A flood barrier according to claim 1 in which the securing means is adapted to cooperate with the frame member.

5. A flood barrier according to claim 1 in which the securing means is configured to be accessible only from within a building that the barrier is deployed to protect.

6. A flood barrier according to claim 1 in which the securing means includes a plurality of wedge elements that can be deployed to secure the shield in position by wedging within an aperture.

7. A flood barrier according to claim 6 in which the wedge elements are secured to the shield by means of flexible connecting components.

8. A flood barrier according to claim 1 in which a door or window within the frame member can be closed while the barrier is deployed.

9. A flood barrier according to claim 1 in which each clip can be deployed to secure the shield to a recess formation surface of the frame member.

10. A flood barrier according to claim 9 in which the recess formation surface is an inwardly-facing surface within a recess formation in the frame member into which a door or window is received when closed.

11. A flood barrier according to claim 1 in which each clip means is adjustable to enable it to be secured to a range of different frames members.

12. A flood barrier according to claim 1 in which in which the shield is made of a rigid material.

13. A flood barrier according to claim 1 in which the shield is made of a suitable plastic, wood or composite material.

14. A flood barrier according to claim 1 in which the shield has a generally flat face that engages with the periphery of the aperture.

15. A flood barrier according to claim 1 in which the shield has a flat peripheral region of a face that engages with the periphery of the aperture.

16. A flood barrier according to claim 1 in which a face of the shield is provided with strengthening formations.

17. A flood barrier according to claim 1 which is formed with a dimension that is greater than a corresponding dimension of the aperture.

18. A flood barrier according to claim 1 in which the sealing element includes an elongate flexible plastic material element.

19. A flood barrier according to claim 1 in which a portion of sealing element extends along part of a flat surface of the shield.

20. A flood barrier according to claim 1 in which a portion of the sealing element extends along part of a peripheral surface of the shield.

* * * * *